US005494284A

United States Patent [19]

Wray, Jr.

[11] Patent Number: 5,494,284

[45] Date of Patent: Feb. 27, 1996

[54] TRACK GUIDED FOOTBALL GAME BOARD

[76] Inventor: Michael Wray, Jr., P.O. Box 945, Bedford, Va. 24523

[21] Appl. No.: 386,150

[22] Filed: Feb. 9, 1995

[51] Int. Cl.[6] ..... A63F 7/06

[52] U.S. Cl. ..... 273/94; 273/331

[58] Field of Search ..... 273/319, 331, 273/332, 334, 335, 320, 321, 413, 414, 451, 402, 94, 85 F

[56] References Cited

U.S. PATENT DOCUMENTS

| | | | |
|---|---|---|---|
| 1,141,624 | 6/1915 | Fullerton | 273/94 |
| 1,537,605 | 5/1925 | Hansen | 273/94 |
| 1,596,833 | 8/1926 | Hemphill | 273/94 |
| 1,617,362 | 2/1927 | Wylie | 273/94 |
| 1,670,703 | 5/1928 | Wylie | 273/94 |
| 1,670,704 | 5/1928 | Wylie | 273/94 |
| 1,838,398 | 12/1931 | Heidbrink | 273/94 |
| 2,520,668 | 8/1950 | Wheeler | 273/94 |
| 3,043,594 | 7/1962 | Seitz | 273/94 |
| 3,554,548 | 1/1971 | Isom | 273/94 |
| 3,838,855 | 10/1974 | Becker | 273/331 |
| 3,966,208 | 6/1976 | Gohsler | 273/331 |
| 4,927,145 | 5/1990 | Davis | 273/331 X |
| 4,948,137 | 8/1990 | Alvarez | 273/413 |
| 5,110,127 | 5/1992 | Potter | 273/94 |

*Primary Examiner*—Sebastiano Passaniti

[57] ABSTRACT

A game board for simulating a football game. The inventive device includes a main panel having lateral panels pivotally attached to opposed longitudinal sides thereof. A track extends along a center of the main panel and supports a ball member for longitudinal movement relative to the board. The track extends between uprights of goal posts positioned at opposed ends of the main panel.

6 Claims, 2 Drawing Sheets

TRACK GUIDED FOOTBALL GAME BOARD

BACKGROUND OF THE INVENTION

1. Field of the Invention

The present invention relates to game board structures and more particularly pertains to an track guided football game board for simulating a football game.

2. Description of the Prior Art

The use of game board structures is known in the prior art. More specifically, game board structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art game board structures include U.S. Pat. No. 3,947,039; U.S. Pat. No. 4,773,650; U.S. Pat. No. 5,186,461; U.S. Pat. No. 5,221,084; and U.S. Design Pat. 294,508.

While these devices fulfill their respective, particular objectives and requirements, the aforementioned patents do not disclose a track guided football game board for a track guided football game board for simulating a football game which includes a main panel having lateral panels pivotally attached to opposed longitudinal sides thereof, and a track extending along a center of the main panel and supporting a ball member for longitudinal movement relative to the board, wherein the track extends between uprights of goal posts positioned at opposed ends of the main panel.

In these respects, the track guided football game board according to the present invention substantially departs from the conventional concepts and designs of the prior art, and in so doing provides an apparatus primarily developed for the purpose of simulating a football game.

SUMMARY OF THE INVENTION

In view of the foregoing disadvantages inherent in the known types of game board structures now present in the prior art, the present invention provides a new track guided football game board construction wherein the same can be utilized for simulating a football game. As such, the general purpose of the present invention, which will be described subsequently in greater detail, is to provide a new track guided football game board apparatus and method which has many of the advantages of the game board structures mentioned heretofore and many novel features that result in a track guided football game board which is not anticipated, rendered obvious, suggested, or even implied by any of the prior art game board structures, either alone or in any combination thereof.

To attain this, the present invention generally comprises a game board for simulating a football game. The inventive device includes a main panel having lateral panels pivotally attached to opposed longitudinal sides thereof. A track extends along a center of the main panel and supports a ball member for longitudinal movement relative to the board. The track extends between uprights of goal posts positioned at opposed ends of the main panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new track guided football game board apparatus and method which has many of the advantages of the game board structures mentioned heretofore and many novel features that result in a track guided football game board which is not anticipated, rendered obvious, suggested, or even implied by any of the prior art game board structures, either alone or in any combination thereof.

It is another object of the present invention to provide a new track guided football game board which may be easily and efficiently manufactured and marketed.

It is a further object of the present invention to provide a new track guided football game board which is of a durable and reliable construction.

An even further object of the present invention is to provide a new track guided football game board which is susceptible of a low cost of manufacture with regard to both materials and labor, and which accordingly is then susceptible of low prices of sale to the consuming public, thereby making such track guided football game boards economically available to the buying public.

Still yet another object of the present invention is to provide a new track guided football game board which provides in the apparatuses and methods of the prior art some of the advantages thereof, while simultaneously overcoming some of the disadvantages normally associated therewith.

Still another object of the present invention is to provide a new track guided football game board for simulating a football game.

Yet another object of the present invention is to provide a new track guided football game board which includes a main panel having lateral panels pivotally attached to opposed longitudinal sides thereof, and a track extending along a center of the main panel and supporting a ball member for longitudinal movement relative to the board.

Even still another object of the present invention is to provide a new track guided football game board wherein the track extends between uprights of goal posts positioned at opposed ends of the main panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
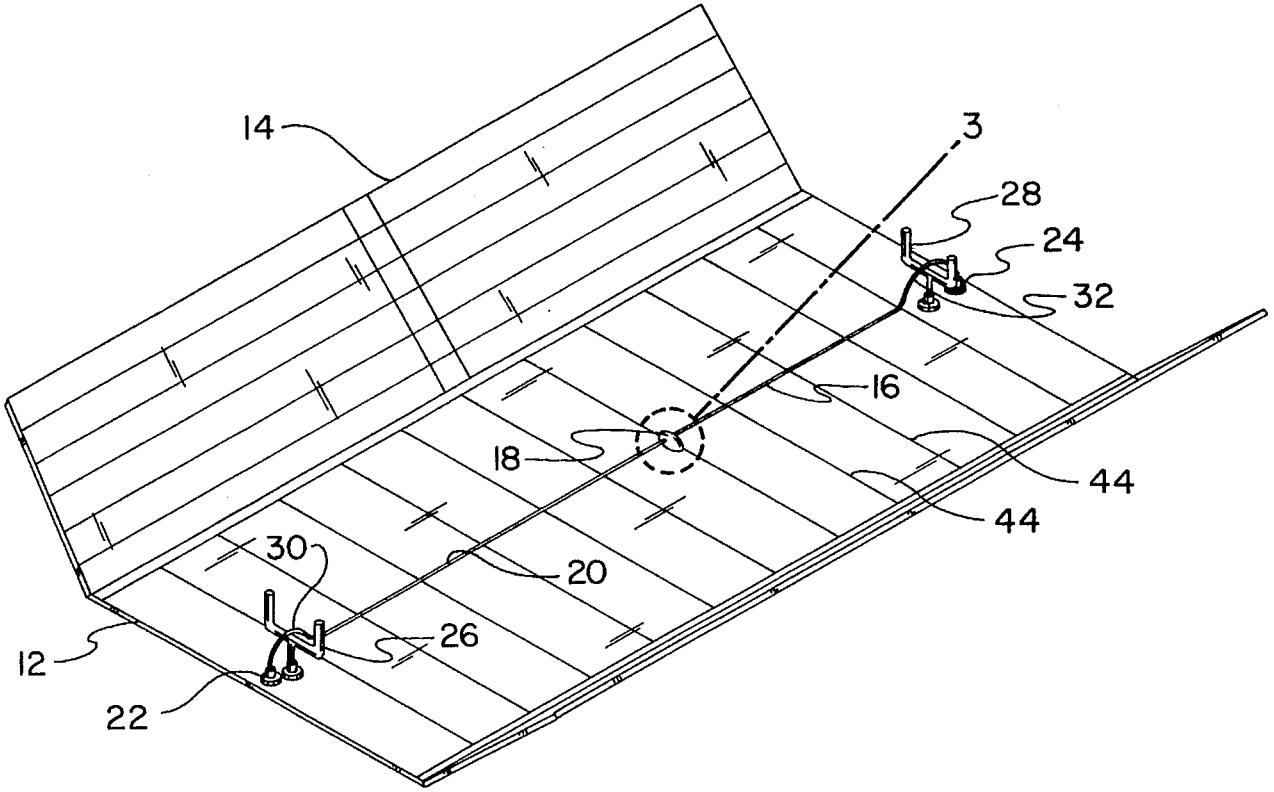
FIG. 1 is an isometric illustration of a track guided football game board according to the present invention in use.

With reference now to the drawings, and in particular to FIGS. 1–6 thereof, a new track guided football game board embodying the principles and concepts of the present invention and generally designated by the reference numeral 10 will be described.

More specifically, it will be noted that the track guided football game board 10 comprises a substantially rectangular main panel 12 having opposed longitudinal sides to which a pair of lateral panels 14 are pivotally attached. A track 16 is supported in a spaced relationship relative to the main panel 12 and supports a ball 18 for longitudinal movement therealong. By this structure, the ball 18 can be selectively positioned along the track 16 during playing of an associated game method.

Figure 2:
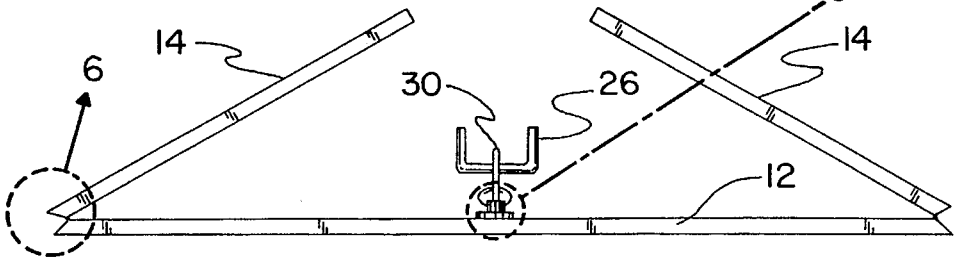
FIG. 2 is an end elevation view of the invention.

As best illustrated in FIGS. 1 and 2, it can be shown that the track 16 according to the present invention 10 preferably comprises an elongated section of wire 20 supported at a first end thereof by a track mounting receiver 22 secured proximal to a first end of the main panel 12. Similarly, the elongated section of wire 20 is supported at a second end thereof by a second track mounting receiver 24 mounted proximal to a second end of the main panel 12.

Preferably and as shown in FIG. 1, the present invention 10 further includes a first goal post 26 mounted proximal to the first end of the main panel 12 and a second goal post 28 similarly mounted proximal to the second end of the main panel 12. In this configuration, the elongated section of wire 20 of the track 16 is preferably shaped so as to define a first raised portion 30 extending over a portion of the first goal post 26 and between the uprights thereof. Similarly, the elongated section of wire 20 is shaped so as to define a second raised portion 32 extending over a portion of the second goal post 28 and between the uprights thereof. By this structure, an individual may accelerate the ball 18 along the elongated section of wire 20 to attempt to position the ball between the uprights of either of the goal posts 26 and 28.

Figure 3:
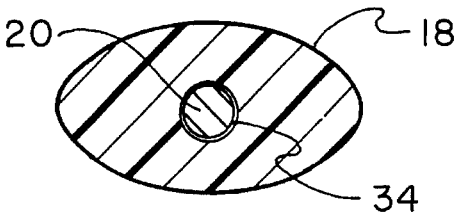
FIG. 3 is a cross sectional view of the area set forth in FIG. 1.

Referring now to FIG. 3, it can be shown that the ball member 18 is shaped so as to define a center aperture 34 through which the elongated section of wire 20 of the track 16 extends. Preferably, the ball member 18 is substantially ellipsoidal in shape, as shown in the cross sectional illustration of FIG. 3, and has a longitudinal width greater than or equal to approximately two times a distance between the raised portions 30 and 32 of the elongated section of wire 20 and a portion of the respective goal posts 26 and 28 over which the raised portions extend. In other words, a distance from the center aperture 34 of the ball member 18 to the outer edge thereof along the longitudinal length thereof should be greater than the distance between the raised portions 30 and 32 and the respective goal posts 26 and 28. By this structure, the ball 18 can only pass over the raised portions 30 and 32 and the goal posts 26 and 28 when oriented in a predetermined position. Thus, an individual accelerating the ball 18 along the elongated section of wire 20 must also ensure that the ball 18 is positioned in the predetermined angular orientation so as to pass over the goal post 26 or 28.

Figure 4:
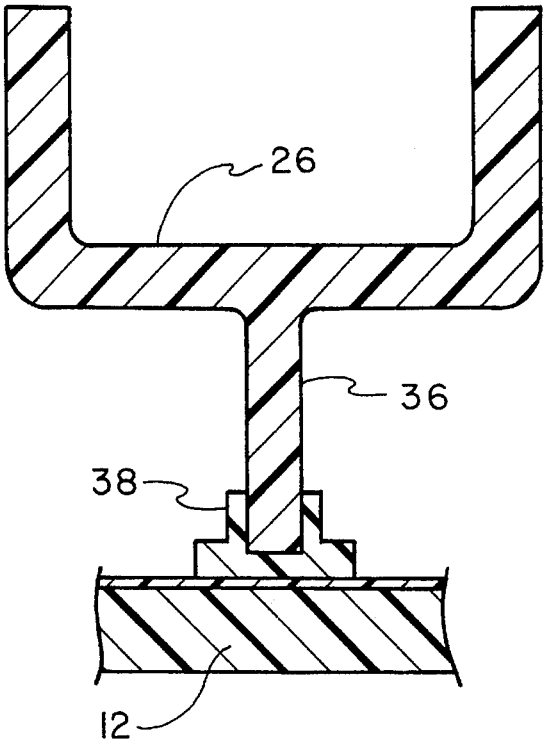
FIG. 4 is a cross sectional view of a goal post of the present invention.
Figure 5:
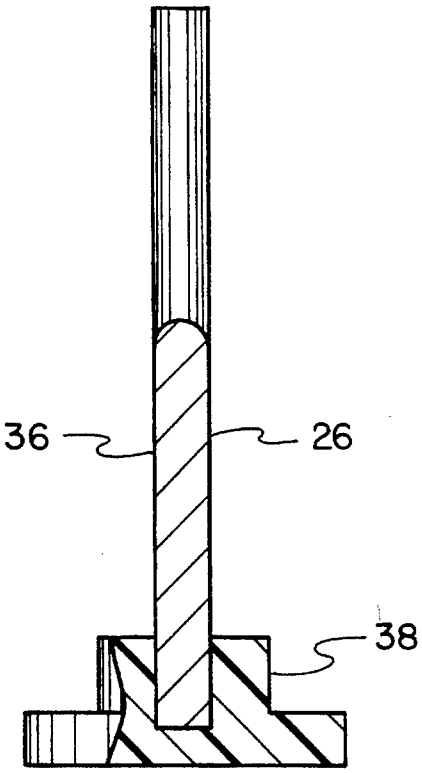
FIG. 5 is a further cross sectional view of a goal post.

As shown in FIGS. 4 and 5, each of the goal posts 26 and 28 comprises a center stanchion 36 received within a goal post mounting receiver 38 secured to the main panel 12. The center stanchion 36 is removably positioned within the goal post mounting receiver 38 for deconstruction for storage and/or transportation purposes.

Figure 6:
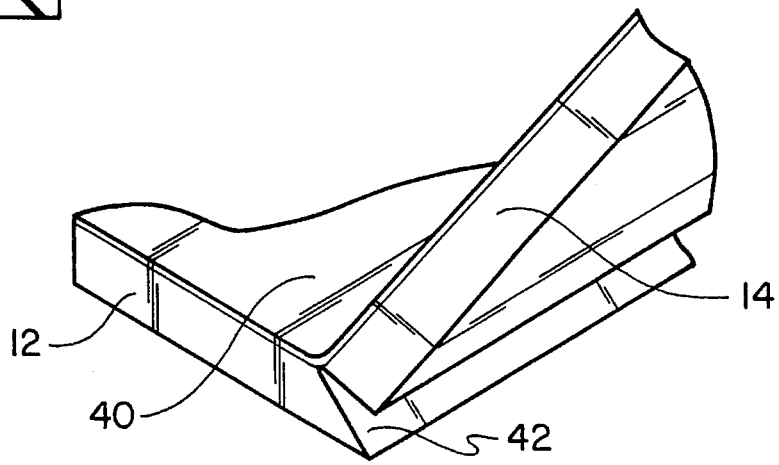
FIG. 6 is an enlarged isometric illustration of the area set forth in FIG. 2.

Turning now to FIG. 6, it can be shown that the lateral panels 14 of the present invention 10 are pivotally mounted to the main panel 12 by a flexible sheet 40 laminated to a top surface of the main panel and the lateral panels. Further, the main panel 12 is shaped so as to define angled longitudinal edges 42 against which the longitudinal edges of the lateral panels 14 abut so as retain the lateral panels 14 at an oblique angle relative to the main panel 12, as illustrated in FIG. 1 for example. As shown in FIG. 2, the flexible sheet 40 providing the pivoting connection between the lateral panels 14 and the main panel 12 permits the lateral panels to be folded flatly against the main panel 12 for storage and/or traveling purposes.

In use, the track guided football game board 10 according to the present invention can be utilized in the playing of a simulated football game wherein dice and cards are also provided. In this connection, the lateral panels 14, although preferably painted so as to simulate grandstand seats filled with people, can be utilized in generating a random number through a rolling of the dice down one the lateral panels. The cards and dice are utilized in combination with spacing indica 44 provided along the main panel 12, whereby positioning of the ball 18 is incrementally achieved during play of the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A track guided football game comprising:

a substantially rectangular main panel having opposed longitudinal sides;

a track supported in a spaced relationship relative to the main panel, the track comprising an elongated section of wire; a first track mounting receiver secured proximal to a first end of the main panel for supporting a first end of the elongated section of wire; and a second track mounting receiver secured proximal to a second end of the main panel for supporting a second end of the elongated section of wire;

a ball movably supported by the track for longitudinal movement along the main panel;

a first goal post mounted proximal to the first end of the main panel, and a second goal post mounted proximal to the second end of the main panel, wherein the elongated section of wire of the track is shaped so as to define a first raised portion extending over a portion of the first goal post and between uprights thereof, and a second raised portion extending over a portion of the second goal post and between uprights thereof, the elongated track being positioned a first distance from an upper surface of the main panel proximal to a center of the main panel, with the raised portions of the elongated section of wire of the track extending to a maximum second distance from the upper surface of the main panel, wherein the second distance is substantially greater than the first distance, wherein an individual can accelerate the ball along the elongated section of wire to attempt to position the ball over one of the raised portions of the elongated section of wire and between the uprights of a respective one of the goal posts.

2. The track guided football game board of claim 1, wherein the ball member is shaped so as to define a center aperture through which the elongated section of wire of the track extends.

3. The track guided football game board of claim 2, wherein the ball member is substantially ellipsoidal in shape, with a longitudinal width of the ball being greater than or at least equal to approximately two times a distance between the raised portions of the elongated section of wire and a portion of the respective goal posts over which the raised portions extend.

4. The track guided football game board of claim 3, and further comprising a pair of lateral panels, each of the lateral panels being mounted to an individual one of the longitudinal sides of the main panel.

5. The track guided football game board of claim 4, wherein the lateral panels are pivotally mounted to the main panel by a flexible sheet laminated to a top surface of the main panel and the lateral panels.

6. The track guided football game board of claim 5, wherein the main panel is shaped so as to define angled longitudinal edges against which the longitudinal edges of the lateral panels abut so as retain the lateral panels at an oblique angle relative to the main panel.

* * * * *